United States Patent [19]

Schwartz

[11] 4,060,965

[45] Dec. 6, 1977

[54] METHOD AND APPARATUS TO MONITOR THREAD SPINNING OPERATION OF OPEN END SPINNING MACHINES AND EFFECTIVE THREAD STOP MOTION

[75] Inventor: Hermann Schwartz, Pfaffikon, Switzerland

[73] Assignee: Siegfried Peyer, Bach, Switzerland

[21] Appl. No.: 730,745

[22] Filed: Oct. 8, 1976

[30] Foreign Application Priority Data

Oct. 10, 1975 Switzerland ..... 13187/75

[51] Int. Cl.[2] ..... D01H 13/22

[52] U.S. Cl. ..... 57/34 R; 57/81; 57/156; 73/160; 324/61 R; 340/259

[58] Field of Search ..... 57/34 R, 81, 156; 73/160; 324/61 R; 226/45; 19/.23; 28/64; 242/36; 340/259

[56] References Cited

U.S. PATENT DOCUMENTS

| | | | |
|---|---|---|---|
| 3,069,621 | 12/1962 | Butticaz et al. | 324/61 R |
| 3,303,698 | 2/1967 | Loepfe | 73/160 |
| 4,007,457 | 2/1977 | Aeppli | 340/259 |

*Primary Examiner*—Richard C. Queisser
*Assistant Examiner*—Charles Gorenstein
*Attorney, Agent, or Firm*—Flynn & Frishauf

[57] ABSTRACT

To prevent periodically recurring thickened portions of thread from open end spinning machines, a thread thickness sensing signal is conducted to a mono stable blocking multivibrator having an unstable blocked time just under, for example, ninety percent, of the time of pull off of thread during one revolution of the turbine, so that the distance of thread passing through the sensor during the unstable time is just slightly less than the circumference of the spinning turbine of the open end spinning machine. If other thickened portions result from a specific circumferential point of the turbine, resulting in periodic defects, the mono stable multivibrator will be triggered again and again; the trigger signals is summed, for example, by an integrator and if the sum of the pulses reach a certain value, a defect signal is generated, for example, stopping the machine. Before being applied to the mono stable multivibrator, the signals are preferably dynamically limited.

17 Claims, 3 Drawing Figures

METHOD AND APPARATUS TO MONITOR THREAD SPINNING OPERATION OF OPEN END SPINNING MACHINES AND EFFECTIVE THREAD STOP MOTION

The present invention relates to a method and apparatus to monitor thread spinning operations when thread is spun in an open end spinning machine, and more particularly to such a system and method in which the thread is passed through an electrical sensor so that electrical signals will be derived representative of instantaneous thread thickness and which will have peaks appearing at instance of time when a thickened portion of the thread passes through the sensor.

Thread has heretofore been made primarily by circular spinning machines. Such circular spinning machines are being increasingly replaced by a new generation of spinning machines, the open end spinning machines. These machines operate more efficiently, since they can directly utilize the carding band, and the spun band can be immediately spooled on large cross-wound yarn packages. The previously utilized intermediate steps and machines, namely, flyers and spooling machines, then need not be used.

A basic element of the open end spinning machines is a turbine operating at very high rotary speeds - usually in the range of about thirty thousand to sixty thousand rpm. the fibers are introduced in the turbine and twisted by the turbine rotation. The carded fibers are introduced as a thick fiber bundle into a resolving apparatus, in which predetermined quantities of fiber material are continuously removed from the carding band and transferred into the spinning turbine. Thread is removed from the center of the turbine through a thread removal tube and can then be directly wound on a cross-wound yarn package. A collecting surface is formed in the interior of the spinning turbine on which the fibers introduced therein deposit, due to the high centrifugal force, and collect into a composite thread which is continuously twisted by the turbine rotation.

The open end spinning machines have one difficulty: Foreign bodies such as tiny wood splinters, remnants of cotton seed housings, knotted fibers and the like will deposit on the interior surface of the spinning turbines. Due to the extremely high centrifugal force, the large mass of these foreign bodies will remain within the turbine without moving with respect thereto. The collecting surface is therefore effectively rendered non-uniform at that point and interference with the collection of fibers will result at that point. As a result, the yarn will have a thicker portion when pulled off from this position.

Ordinarily, thickened portions in thread having random distribution over the length thereof, do not interfere with the appearance of the final product, in which the thread is used. If the thickened portions occur repetitively, however, and always exactly in the distance of the turbine circumference, or its distribution surface, then one of the more annoying defects of the open end spinning method results. These hardly visible thickened portions of the thread will result in appearance defects only when the thread is used in a woven fabric. Due to the periodically repetitive distance of the thickening on the thread, in a continuous sequence, and in a determined distance from each other, the thickened portions will appear as such in the final woven product. As a result, if the thread is used in a weaving loom, a continuous and clearly visible pattern will form which extends at an acute angle over the entire width of the woven material. This is the dreaded Moire effect. The woven material and the thread are, therefore, completely useless and result in substantial losses and costs to the manufacturer of the thread.

The open end spinning method thus, requires extreme cleanliness and causes constant concern that one or more of the turbines have been contaminated with foreign bodies and that yarn thread is produced having periodically repetitive thickened portions. Unless this is discovered by accident, substantial quantities of useless yarn may have been produced. The introduction of the open end spinning machines, thus, required a different type of thread monitoring supervision system than that heretofore known, namely, a system in which periodically appearing thickened portions can be detected early and their presence signalled before a substantial quantity of the defective thread has been produced.

Various solutions have been suggested, such as amplitude selection, frequency selection, and the like; they had, however, limits and weaknesses and could not guarantee reliable supervision of yarn with respect to repetitively occuring defects. The problem in supervision is in the nature in the twisted or spun fibrous thread itself. It is well known that any type of spun fibrous thread varies in thickness and is continuously subjected to changes in its dimensions; the reason seems to be the non-uniform distribution of fibers, which is not necessarily due to the type of the spinning procedure which is used. These statistically distributed non-uniformities in the thread will provide, when the thread thickness is sensed, an electrical signal which is akin to random noise signals and, therefore, has been termed the "thread noise". These signals are used in many types of instruments for supervision of thread manufacture, for example, to supervise the presence of thread, for stop motion devices, or for thread cleaning systems. Periodic variations in thickness as derived from open end spinning apparatus frequently does not exceed the normal variations in thickness of the yarn itself; on the contrary, the signal amplitude of the periodically recurring thickened portion, when sensed electrically, may be less than other thickness variations and therefore, electrical signals will disappear within the average thread noise signal. The periodically recurring thread defects, as caused by foreign bodies in open end spinning machines thus cannot be detected by their signal amplitude. The problems of recognition of these particular defect signals is thus enormously complicated. Tests have been made to analyze the signal with respect to frequency; this is extremely expensive and complicated and further, introduces problems if a central testing apparatus is to be used to control a plurality of supervisory or monitory systems, and especially if apparatus is to be devised which can match any number of different diameters of spinning turbines and thread pull-off speeds.

It is an object of the present invention to provide a system and a method which permits reliable determination and evaluation of periodically repetitive non-uniformities in thread, while being simple and sufficiently inexpensive so that use with a large number of spinning turbines is economically possible.

Subject matter of the present invention: Briefly, signals which are above a certain threshold and which represent thickened portions, or other irregularities in the produced yarn and which repeat periodically spaced from each other by the circumference of the spinning turbine are determined and the so determined repeating signals are added; after a certain threshold of added signals has been reached, the sum of the signals is then used to provide a defect signal which can be used to generate an alarm, or stop the machine.

In accordance with the preferred method and system, thread is sensed in a thread sensor and the derived electrical signal is applied over an amplifier to a trigger circuit which generates peak signal pulses each time when a peak of the signal is sensed, so that the pulses will represent thickened portions, or other irregularities of the thread. These pulses are then used to determine the periodically recurring repetition of the thickened portions, that is, if the thickened portions have a distance from each other which corresponds to the circumference of the surface of the spinning turbine where foreign bodies may lodge. To make this determination, the pulses are applied as trigger pulses to a blocking mono stable multivibrator (MMV), which has a blocked, or unstable, time which is just slightly less than the repetition time between periodically repetitive pulses representing such thickened portions spaced by the distance of the turbine. If a further pulse occurs after the MMV returns to its stable state, it is triggered again, and so on, each time providing an output pulse which then can be counted.

In accordance with a feature of the invention, the time constant of the unstable time of the MMV is set to be about ninety percent of the repetition rate between periodically recurring pulses — considering the pull-off speed of the thread. The threshold value for the peaks of the signals representing thickened portions or other defects of the thread are preferably set dynamically by a dynamic limiting circuit, similar to an automatic gain control circuit, or limiter. The number of the repetitive signals which are summed can be adjusted so that the recognition threshold of defects can be determined.

The invention will be described by way of example with reference to the accompanying drawings wherein.

A thread F is pulled off an open end spinning machine (not shown) and passed through a sensor 1 which may be any one of a well known photo-electric or capacitative transducer which provides an electrical signal representative of the thickness of the thread F at the discrete, or instantaneous position of the thread as it passes through the sensor. The thread F is made in a spinning turbine, as described.

Upon being pulled off, the thread passes through a measuring cell 2, then to be wound up on a thread package or the like (not shown).

Figure 1:
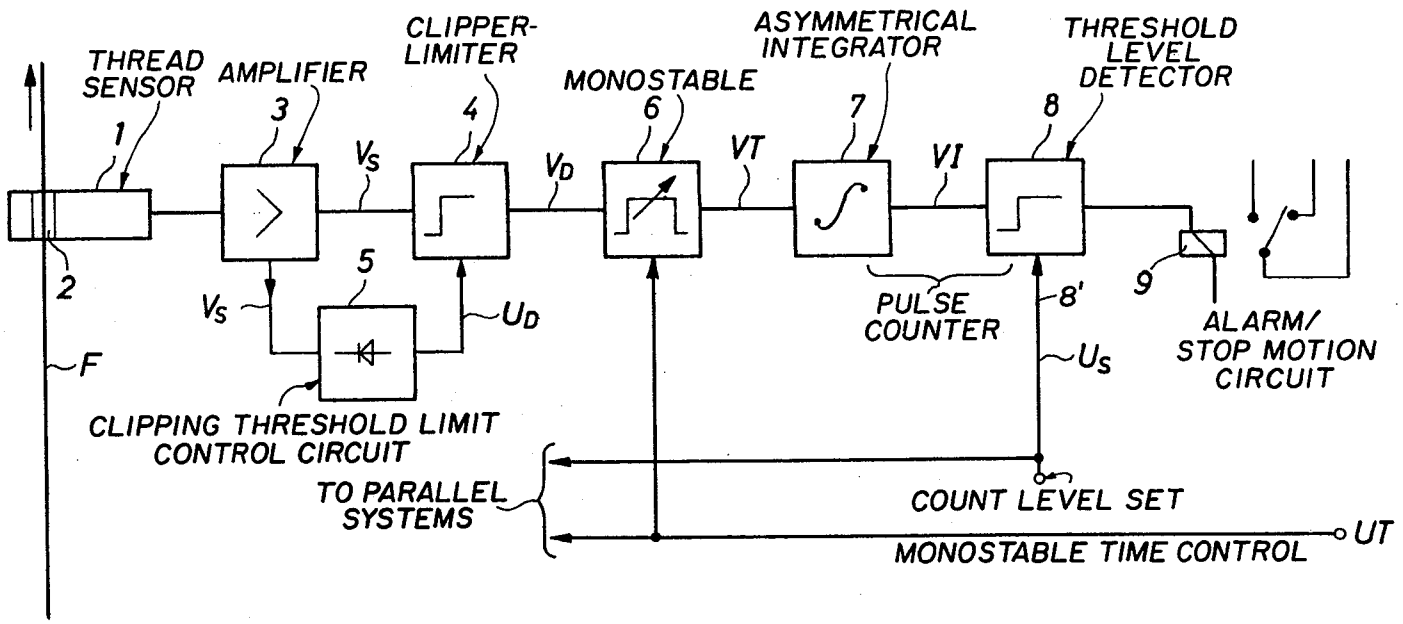
FIG. 1 is a schematic block diagram of the system in accordance with the present invention.
Figure 2:
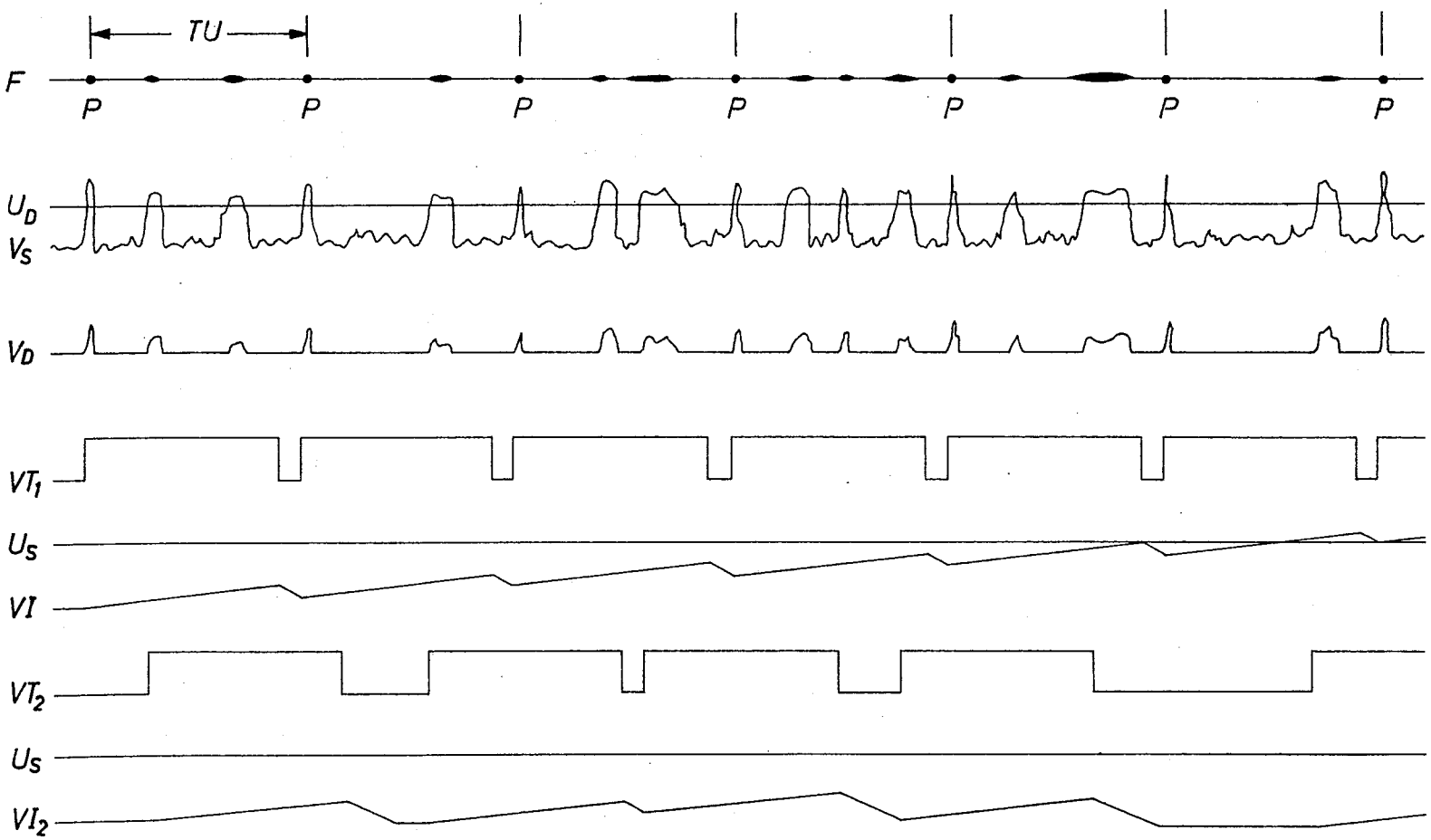
FIG. 2 are timing diagrams illustrating signals appearing at the various elements of the circuit of FIG. 1 and referred to in connection with the explanation of the operation of the system and with the method of the present invention.

The graph F of FIG. 2 shows a portion of a thread having periodically recurring thickened points P, generated in an open end spinning turbine, as described above. The thread has additional thickened portions as schematically shown. The time taken by the portion of the thread between two thickened portions P is shown as TU, and corresponds to the time of the circumference of the turbine to make one revolution since the points P are physically spaced from each other by the distance of the turbine surface circumference. The electrical signal derived by transducer 1 is shown in the graph $V_S$. This signal is amplified in amplifier 3 (FIG. 1) connected to the cell 2 of the sensor 1.

The curve $V_S$ of FIG. 2 clearly shows a substantial number of irregularities in the yarn which are statistically distributed at random. The thickened portions P, recurring periodically, disappear entirely among the various noise signals. To provide for discrimination of peaks, signals $V_S$ are clipped, or limited, and only those signals which exceed a threshold level $U_D$ are further processed. The limiting level $U_D$ is derived by rectifying the amplified signal in amplifier 3 and storing the rectification of the signals $V_S$ to derive the derived signal portions $V_D$ which then will have such a shape that the leading pulse flank of the $V_D$ signal portions can reliably trigger a subsequent wave shaping circuit.

The $V_D$ signal portions appear at the output of a Schmitt trigger 4, connected to the amplifier 3. The Schmitt trigger 4 receives its threshold control signal of the value $U_D$ from an automatic limiting control circuit 5, which derives the signal automatically from the signal level of the signals $V_S$ at the output of amplifier 3.

The leading edge $V_D$ output signals at the Schmitt trigger 4 are then applied to a mono stable multivibrator (MMV)6 to trigger the mono stable multivibrator to unstable time.

The MMV 6 has a time constant which is approximately ninety percent of the time TU, that is, of the time taken by a random length of yarn generated during one revolution of the turbine, or, in other words, the length of yarn between two periodically recurring thickened portions, or points P at pull-off speed. The MMV 6 is a blocking type MMV, that is, it can be triggered to unstable time only after it has reverted to its stable state, that is, after the time constant of its unstable time has completely elapsed. The blocking MMV 6 is thus triggered necessarily only by the signals of the periodically recurring thickened points P. The output of the blocking MMV 6 is shown in FIG. 2, graph $V_{T-1}$. The $V_{T-1}$ square wave signals are then applied to a pulse counter to form a sum signal. This pulse counter, as shown in FIG. 1, includes an integrator 7 and an integration level detector. The integrator has two integration rates: The rising integration rate is substantially longer than the falling rate, preferably in a ratio 2:1 or more. For a reliable evaluation of recurring signals it is important that the decay time of the integrator 7 is substantially less than the rise time. A threshold switch 8, forming a level detector, is connected to the output of the integrator 7 to detect if the integrator output voltage has risen to a predetermined level, shown in FIG. 2 as level $U_S$. The integration action of the integrator 7 is illustrated in graph VI of FIG. 2. The integrator signal VI will trigger a defect signal after six periodically repetitive yarn defect points P have been sensed, so that defective yarn will be rapidly detected. The graph has been shown exaggerated for purposes of illustration. In actual practice, it is desirable to so set the time constant of the integrator 7 and the threshold value of the threshold voltage $U_S$ that a substantially greater number of signals are counter, for example 20 – 30 signals corresponding to defect points P, thereby providing for better and more reliable discrimination.

The threshold level detector 8 controls a relay 9 which can be used, for example to disconnect the respective spinning turbine and to provide an alarm signal.

The threshold level $U_S$ at the threshold level detector 8 should be externally adjustable. In large spinning installations, where a plurality of turbines operate in parallel, a common control should be present for all the turbines. The customary open end spinning machines have a large number of turbines, and each turbine requires a separate control system as described. The system should, however, operate uniformly.

The time constant of the blocking MMV 6 is preferably set to be about 90% of the time TU (FIG. 2). Since different turbines may have different turbine diameters, and different thread pull-off speeds, the time period of the MMV must be adjustable. A complete open end spinning machine may have up to 200 turbine assemblies and may, therefore, require about 200 monitoring apparatus and systems. This requires 200 associates MMV circuits 6 which should also be uniformly and commonly controllable. Various MMV circuits are available as integrated circuits, for example, the timer 555 has a voltage controlled time constant, which can be adjusted by means of a voltage $U_T$, so that sensor control from a central power supply is possible. Let it be assumed, that the signals $V_S$ and $V_D$ then will not arise; only the statistically distributed yarn or thread thickness signals will remain. The MMV 6 will then be triggered each time by the signal which occurs after the time constant thereof, 90% of TU has elapsed. The square wave signals $V_{T-2}$ in FIG. 2 will then arise. If this square wave signal is applied to the integrator 7, the integrator will integrate the signal in accordance with the curve $V_{I-2}$. As can readily be seen, the rapid decay time of the integrator 7 will prevent a signal from the integrator to reach the threshold level $U_S$, since only a few somewhat wider pauses are sufficient to drop the integrated signal to an average value well below the threshold level $U_S$.

The apparatus, as described, thus monitors thread produced on an open end spinning machine and reliably detects irregularities in produced threads which repeat periodically and provide output signals indicating defective yarn thread production before a substantial length of thread has been produced.

Thread defects, which appear repetitively, spaced by the distance of a circumference of the spinning turbine and which are of a value that they are above the threshold level $U_D$ can be reliably determined and counted to form a signal which indicates defects in the thread manufacture. The thread pull-off speed from the turbine essentially determines the desired thread number. The thread pull-off speed can thus be considered as constant and can be accurately determined and can be considered to be maintained constant with good accuracy. The time that any length of thread between two periodically repetitive thickened points P takes can readily be determined from known data derived from the diameter of the turbine surface and the pull-off speed; these data are known for any machines. The time constant of the MMV 6 can then be matched accurately to the time TU; in a preferred method, it is approximately 90% of this time, although this value is not critical and suitable time periods, somewhat less than the time TU can be used. The blocking MMV 6 must be re-triggered each time after its unstable time has been completely elapsed. Thus, yarn defect signals which follow a repetitively occuring signal P will have no influence on the behavior of the MMV 6 and thus cannot provide erroneous outputs of the later result. The possibility that erroneous signals are considered as periodic defects is reduced to 10%. Due to statistically occurring signals, the probability has been substantially reduced. Even if in single instances a non-repetitive signal falls within the last 10% of the time TU, then it would only trigger the MMV 6 somewhat earlier and the subsequent result would be influenced only slightly. Large series of incorrect signals would have to occur in order to fall, consistently, within the last 10% of the time TU. Statistically, and based on probability theory, this is not apt to arise; if it should occur anyway, then these defects would also be periodically occurring defects having the same moire effect, even if the cause is not a foreign body or other contamination of the turbine itself.

Figure 3:
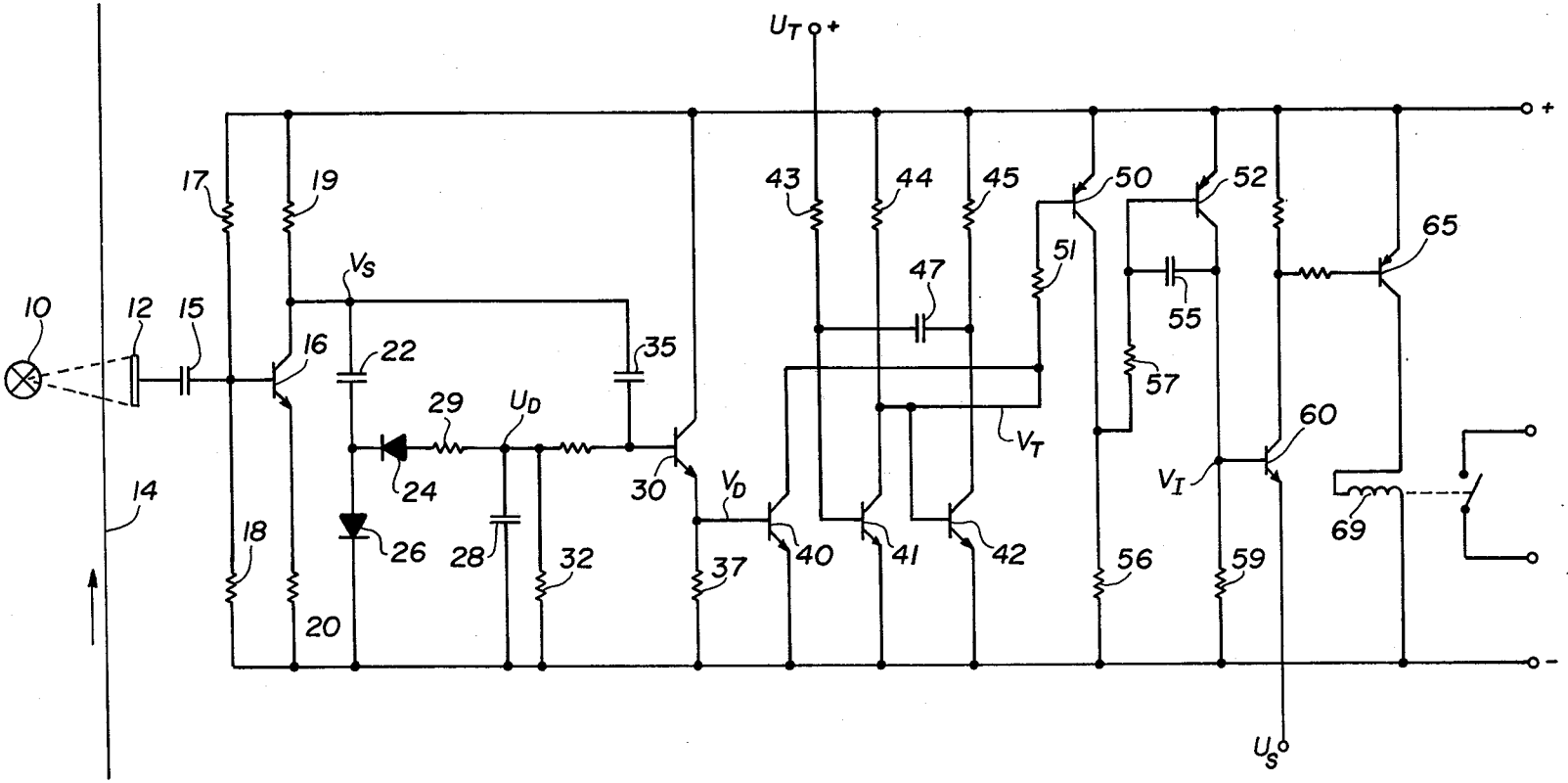
FIG. 3 is a circuit diagram corresponding to the block diagram given in FIG. 1.

FIG. 3 is an actual circuit diagram corresponding to the block diagram given in FIG. 1. As there shown the lamp 10 and the photo cell constitute the measuring elements such as are found in similar known devices, for example a photo-electric yarn cleaner. As the thread 14 runs through the light beam of this measuring head, the photo cell 12 produces a signal representative of the thread. The irregularities of this signal, corresponding to yarn irregularity, are supplied to the input of an amplifier through the coupling capacitor 15. The amplifier is of a known type, consisting of transistor 16 and associated resistors 17, 18, 19 and 20. The amplified signal, designated $V_S$ in FIG. 1, appears across resistor 20.

The signal $V_S$ is then coupled by capacitor 22 to a rectifier circuit consisting of the diodes 24 and 26 which charges the capacitor 28 negatively through the resistor 29. In consequence, the base of transistor 30 is provided with a negative bias that appears on FIG. 1 with the designation $U_D$. Resistor 32 is in shunt with capacitor 28 and the relative magnitudes of resistors 29 and 32 and capacitor 28 are such as to provide a relatively large time constant, so that the negative bias voltage $U_D$ corresponds to the average for a great length of yarn, and isolated variations and transitory changes produce no appreciable change in $U_D$. The relative magnitudes of $U_D$ and $V_S$ can be determined by the ratio of the charging resistor R5 and the discharging resistor R6.

Capacitor 35 couples the signal $V_S$ to the base of transistor 30 which is biassed as already described. The signal components designated in FIG. 1 as $V_D$ appear across resistor 37.

The signal $V_D$ makes transistor 40 conducting, bringing the collector voltages of transistors 40 and 42 quickly to the potential of the negative side of the circuit. This has the result that the timing circuit, a monostable circuit consisting of transistors 41 and 42, resistors 43, 44 and 45 and capacitor 47 switches over and remains in the switched-over state for a predetermined characteristic time. The resistor 43 can be connected to a variable positive voltage $U_T$ in order to select or adjust the characteristic time period of the monostable circuit, since the capacitor 5 can be caused to change its charge to the potential of the base of transistor 41 at a rate depending on the voltage applied through the resistor 43 to bring about the return of the monostable circuit to its original condition. During the switched-on time of the monostable circuit the transistor 42 is conducting so that during this time the signal $V_D$ on the base electrode of transistor 40 can produce no consequences. Only after the monostable circuit has returned to its original condition can the next signal $V_D$ trigger the monostable circuit again. A transistor 50 has its base coupled to the base of transistor 42 and the collector of transistor 41 through a resistor 51 and operates to switch the signal designated in FIG. 1 as $V_T$ on and off. The transistor 50 is connected as an emitter-follower and supplies an input to the base of transistor 52 which operates as an integrator because of the capacitive feedback provided by capacitor 55.

When the monostable circuit is triggered, transistors 41 and 50 are non-conducting for the time period VT. The capacitor 55 of the integrator charges over the series-connected resistors 56 and 57 gradually in the negative direction which results in a positive voltage rise at the collector resistor 59. After the time VT, transistors 41 and 50 are again conducting, so that the integrating capacitor 55 now discharges over resistor 57 alone and the virtual short-circuit provided by transistor 52. By suitable dimensioning of the ratio of the magnitudes of resistors 56 and 57 the desired slow rise and much faster fall of the integrator voltage can be set. By the integration of the VT signal the rising voltage VI across the resistor 59 is applied to the base of the transistor 60, which has its emitter connected to a positive potential $U_S$ that is variable with respect to the negative voltage lead of the circuit. By setting $U_S$ the desired number of VT signals necessary to reach the switching threshold can be selected. Whenever the threshold set by the voltage $U_S$ is exceeded at the base of transistor 60, the transistor becomes conducting and switches transistor 65 to operate the relay 69 which corresponds to the relay 9 in FIG. 1.

Various changes and modifications may be made within the scope of the inventive concept.

I claim:

1. Method to monitor the thread spinning operation of open end spinning machines having spinning turbines comprising the steps of generating an electrical signal ($V_S$) representative of thread thickness and having peaks where the thread thickness deviates from an average condition;

wave shaping said signal to provide peak signal pulses upon occurrence of said peaks, which peak signal pulses will be representative of thickened portions of the thread;

applying said peak signal pulses to a triggerable blocking circuit having a predetermined blocking time when triggered by a peak signal pulse, said blocking time being shorter than the repetition time of periodically repeating peak signal pulses which are derived from irregularities in the thread, and spaced by a distance related to the circumference of the spinning turbine to obtain output pulses from the blocking circuit which recur only if the peak signal pulses repeat periodically to retrigger the blocking circuit after its blocking time has elapsed;

adding the blocking circuit output pulses and generating a defect signal when the addition of the blocking circuit output pulses results in a sum which exceeds a pre-determined value.

2. Method according to claim 1 wherein the blocking time is approximately 90% of the repetition time of the periodically repetitive peak signal pulses.

3. Method according to claim 1 further comprising the step of dynamically deriving an electrical reference signal ($U_D$) from said generated electrical signal ($V_S$) to provide a dynamically weighted signal representative of average thread thickness and selecting said peak signal pulses only from the peaks occurring in the electrical signal which exceed said reference signal.

4. Method according to claim 1 wherein the step of adding the blocking circuit output pulses comprises controlling the number of signals to be added by a control signal.

5. Method according to claim 1 wherein the step of adding the blocking circuit output pulses comprises counting the pulses in a counter stage (7, 8) having an incrementing and decrementing counting means and counting forwardly during occurrence of the pulses and decrementing the count upon cessation of occurrence of said pulses, the forward count occurring at the rate which is slow with respect to the counting rate of the decrementing count.

6. Thread production monitoring system to supervise thread being spun by an open end spinning machine, having a spinning turbine, and having a thread thickness sensor (1, 2) providing an electrical signal ($V_S$) representative of thread thickness and having peaks where the thread thickness deviates from an average condition;

wave shaping circuit means (3, 4, 5) providing trigger signals upon occurrence of signal peaks in the electrical signal;

and comprising, a blocking timing circuit (6) triggered by the wave-shaped trigger signals and providing a pulse ($V_{T-1}$) and having a blocking time which is a little less than the repetition time of periodically repetitive defects in the thread, as determined by the spinning turbine diameter and pull-off speed of the spinning machine to permit the timing circuit (6) to be retriggered by periodically repetitive signals but to remain in its blocked state during the predominant portion of time between periodically recurring thread defects;

counter circuit means (7, 8) counting the pulses from the blocking timing circuit (6) and defect signal generating means (9) providing a defect signal when the counter circuit means has counted a predetermined number of pulses from the blocking timing circuit (6) indicative of a plurality of periodically recurring defects in the thread.

7. A system according to claim 6, wherein the blocking timing circuit is a monostable multivibrator (6).

8. A system according to claim 6 wherein the blocking time of the timing circuit (6) is externally adjustable.

9. A system according to claim 8 wherein the adjustment of the blocking time of the timing circuit (6) is electrical signal controllable.

10. A system according to claim 6 wherein the counter circuit means comprises an integrator (7) connected to the blocking timing circuit (6) and a threshold level detector (8) connected to the integrator (7).

11. A system according to claim 10 wherein the threshold level of the threshold level detector (8) is externally signal controllable.

12. A system according to claim 6 wherein the count number of the counter circuit means at which the defect signal generating means (9) provides a defect signal is externally signal controllable.

13. A system according to claim 11 wherein the integrator (7) has a shorter decay time than its integrating rise time.

14. A system according to claim 6 wherein the counter circuit means (7, 8) has an incrementing-decrementing counter means counting at an incrementing rate during pulses from the blocking timing circuit (6), and decrementing the count during gaps in pulses from the blocking timing circuit (6), the incrementing counting rate of the counting circuit means being slower than the decrementing counting rate.

15. An open end spinning machine having a plurality of spinning turbines and comprising a plurality of systems according to claim 6, one each system being associated with a spinning turbine;

and a common control means connected to the blocking timing circuits (6) of the respective systems to commonly control the blocking time constants thereof.

16. An open end spinning machine having a plurality of spinning turbines and comprising a plurality of systems according to claim 6, one each system being associated with a spinning turbine;

and a common count level control means connected to the counter circuit means of the respective systems to commonly control the count number of the systems at which the respective defect signal generating means will provide a defect signal.

17. Open ended spinning machine according to claim 16 further comprising a common blocking time control means connected to the blocking timing circuits (6) of the respective systems to commonly control the blocking time constants thereof;

and wherein the counter circuit means (7, 8) of the respective systems have incrementing-decrementing counting means counting in incrementing direction during pulses from the respective timing circuit (6) and counting in decrementing direction during gaps of pulses from the respective timing circuit (6), and the respective counting means have incrementing counting rates which are less than the decrementing counting rates in a ratio of at least about 1:2.

* * * * *